US006820870B2

(12) United States Patent
Eugster

(10) Patent No.: US 6,820,870 B2
(45) Date of Patent: Nov. 23, 2004

(54) DEVICE FOR OPENING AND INSERTING PRINTED PRODUCTS IN A GATHERING LINE

(75) Inventor: Albert Eugster, Strengelbach (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/287,699

(22) Filed: Nov. 5, 2002

(65) Prior Publication Data

US 2003/0085503 A1 May 8, 2003

(30) Foreign Application Priority Data

Nov. 8, 2001 (EP) ..... 01811077

(51) Int. Cl.[7] ..... B65H 39/02
(52) U.S. Cl. ..... 270/52.25; 270/52.23; 271/315
(58) Field of Search ..... 270/52.23, 52.24, 270/52.25; 271/315

(56) References Cited

U.S. PATENT DOCUMENTS 4,046,367 A * 9/1977 Merker et al. ..... 270/52.24
4,723,770 A * 2/1988 Seidel et al. ..... 270/52.2
5,065,994 A * 11/1991 Hatt ..... 270/52.23
5,112,036 A * 5/1992 Hatt ..... 270/52.23
5,269,504 A * 12/1993 Backman ..... 270/52.2
6,234,466 B1 * 5/2001 Infanger ..... 270/52.23
6,311,968 B1 * 11/2001 Linder et al. ..... 270/52.25

FOREIGN PATENT DOCUMENTS

EP 0 336 062 B1 10/1989
EP 0 498 935 A1 8/1992

* cited by examiner

*Primary Examiner*—Patrick Mackey
(74) *Attorney, Agent, or Firm*—Venable LLP; Robert Kinberg

(57) ABSTRACT

An insertion and gathering device having two deflection wheels, a conveying apparatus circulating around the deflection wheels, receiving containers coupled to and moved along successively by the conveying apparatus with each receiving container having a pocket with an open upper end constituting an insertion opening and extending crosswise to the conveying direction, a feed station for feeding folded products into the insertion openings, a removal station for removing folded products from the receiving devices, and a stationary opening device for opening the folded products arranged between the feed station and the removal station downstream of the first deflection wheel.

20 Claims, 4 Drawing Sheets

DEVICE FOR OPENING AND INSERTING PRINTED PRODUCTS IN A GATHERING LINE

CROSS-REFERENCE TO RELATED APPLICATION

This application claims priority to European Patent Application No. 01811077.5-1526, filed Nov. 8, 2001, the disclosure of which, together with the disclosure of each U.S. and foreign patent and patent application mentioned herein, is incorporated herein by reference.

BACKGROUND OF THE INVENTION

The invention relates to a device for the insertion and gathering of printed products in pocket-type receiving containers which extend lateral to the conveying direction and are provided with feed openings at the upper end. The containers are moved one behind the other on a conveying apparatus that circulates around two deflection wheels. Between a feed station for feeding in the printed products and a removal station for removing the printed products with inserts, the device is provided with a stationary opening device that opens the printed products which are supplied fold first by a feeding device.

Devices of this type are also called insertion machines and are used, for example, in newspaper production.

An arrangement of this type, as defined in European Patent 0 336 062 B1, is provided with an opening device that is effective on the side of a rotationally driven twin chain wheel and following a main product inserting station. With this type of arrangement, the printed products supplied for opening cannot settle down because of the short moving distance to the opening device, so that the opening operation cannot be carried out reliably.

This type of device for opening printed products furthermore can be realized only in connection with a drive wheel or a deflection wheel and is very costly if several opening stations are arranged along a conveying apparatus.

SUMMARY OF THE INVENTION

It is an object of the invention to create a device of the aforementioned type which eliminates the previously mentioned disadvantages and which meets the requirements of modern-day processing.

This object is solved by exemplary embodiments of the invention which provide that the opening device is installed behind a first deflection wheel, as seen in a conveying direction.

Embodiment of the invention provide an insertion and gathering device for folded products. The device has two deflection wheels arranged at a distance to one another and a conveying apparatus which circulates around the two deflection wheels. Receiving containers are coupled to the conveying apparatus and are moved along successively by the conveying apparatus in a conveying direction, the receiving containers each having a pocket with an open upper end constituting an insertion opening and extending crosswise to the conveying direction. A feed station is provided for feeding the folded products into the insertion openings of the receiving devices fold first, and a removal station is provided for removing folded products from the receiving devices. A stationary opening device for opening the folded products is arranged between the feed station and the removal station and downstream of the first deflection wheel as seen in the conveying direction.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
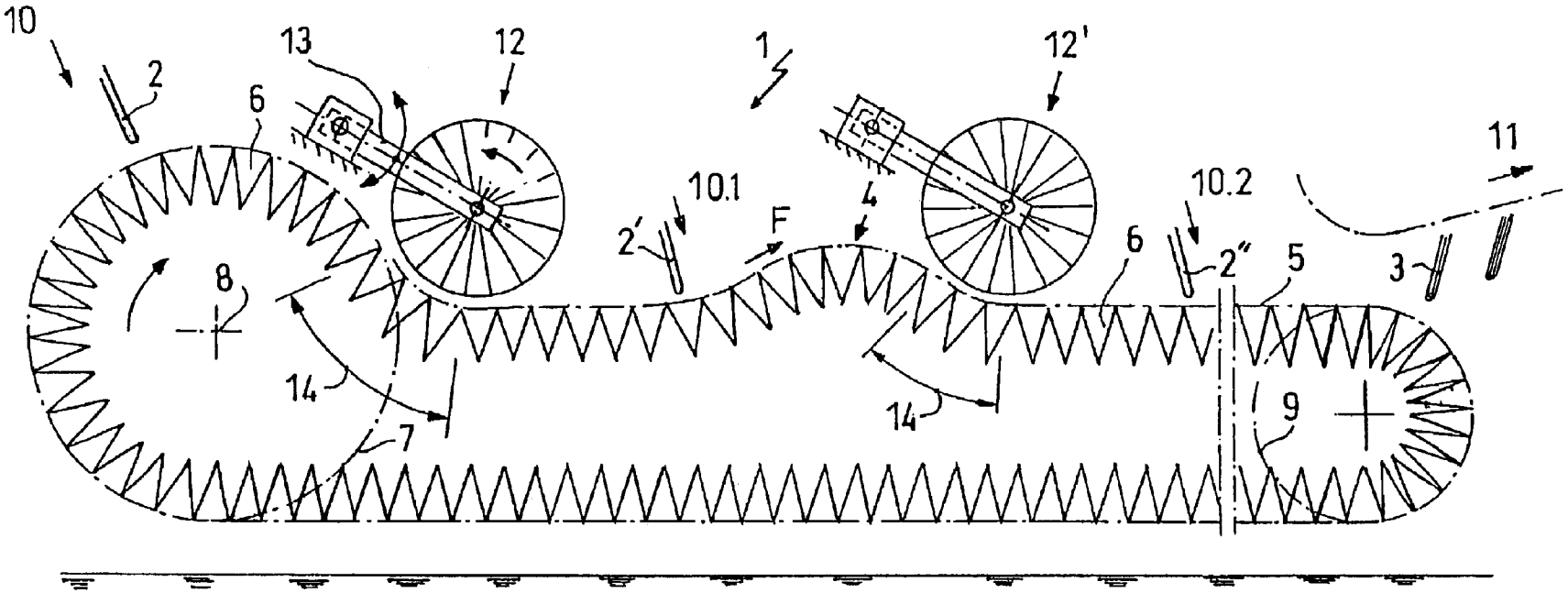
FIG. 1 is a schematic side elevation view of a device according to the invention.

FIG. 1 schematically shows a device 1 according to an embodiment of the invention. Device 1 is for inserting and gathering main products 2 to form finished products 3. Device 1 comprises a conveying apparatus 4, comprising two endless conveying chains 5, moving side by side, which are connected by pocket-type receiving containers 6 that extend laterally relative to the conveying direction F. The latter are designed with a feed opening at the upper end and, for the exemplary embodiment shown, circulate at one end on a deflection wheel 7 around an axis 8. A deflection wheel 9 having a smaller diameter than deflection wheel 7 is provided at the opposite conveying end of device 1. Of the two deflection wheels 7, 9, one can be designed as a drive wheel for the conveying apparatus 4. Between the deflection wheels 7, 9, the conveying chains 5 move in side-mounted guide rails that are not shown in FIG. 1.

The upper run of the circulating conveying chains 5 forms a conveying section that extends from the first feed station 10 for the main product 2 to a removal station 11 for the finished product 3. Additional feed stations 10.1 and 10.2 are provided along the conveying section and are indicated by an arrow. Opening devices 12, 12' (referred to as feeders) which open up the main products 2 inserted into the receiving containers 6 are arranged downstream and at a distance to the feed stations 10, 10.1, 10.2 along the conveying path for the main products 2. The main products 2 are preferably opened during the conveying operation and not in cooperation with the deflection wheel 7.

FIG. 1 also shows that the opening device 12 can be removed from the processing region if it is not in use. The opening device 12 is attached, for example, to an arm 13 that can be pivoted upward. For the exemplary embodiment shown here, the opening device 12 (designed as a rotor), which is fed the main product 2, is shown following the deflection wheel 7 in the conveying direction. The circumference of the opening device 12 and the conveying apparatus 4 (that moves in the same direction) form an approximately sector-type opening segment and/or section 14. Following the opening device 12, an additional feed station 10.1 is provided along the conveying section in which an insert 2' is inserted fold first into an opened main product 2 that is moving past in a receiving container 6. An additional opening device 12' is provided further downstream for inserting an additional insert 2" into the insert 2'. To create an opened section, the conveying apparatus 4 is raised in the manner of a hump in front of the opening device 12' and is lowered again in front of the opening device 12' proximate to the perimeter of the opening device 12'.

Figure 2:
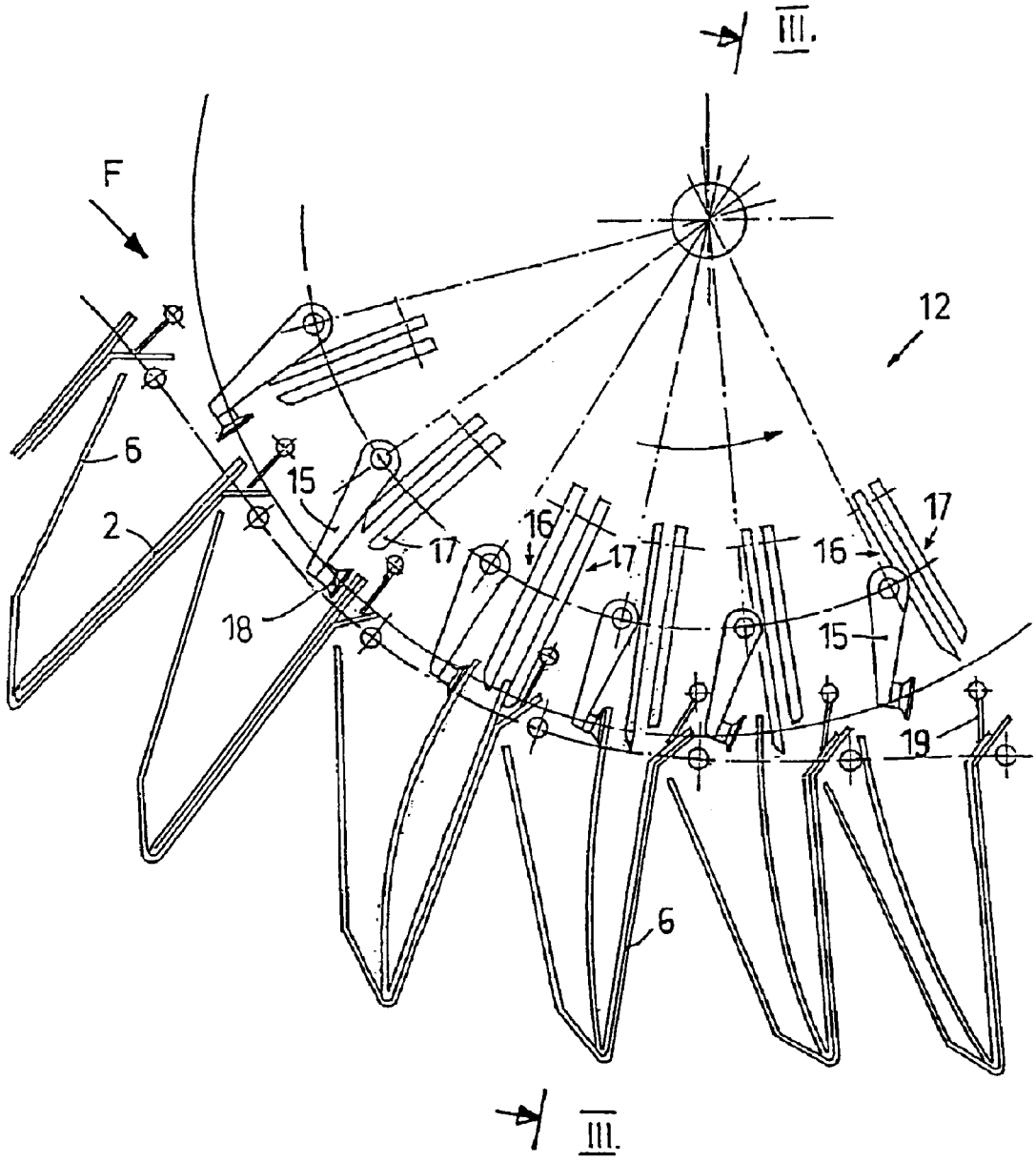
FIG. 2 is a detail view of the device shown in FIG. 1.
Figure 3:
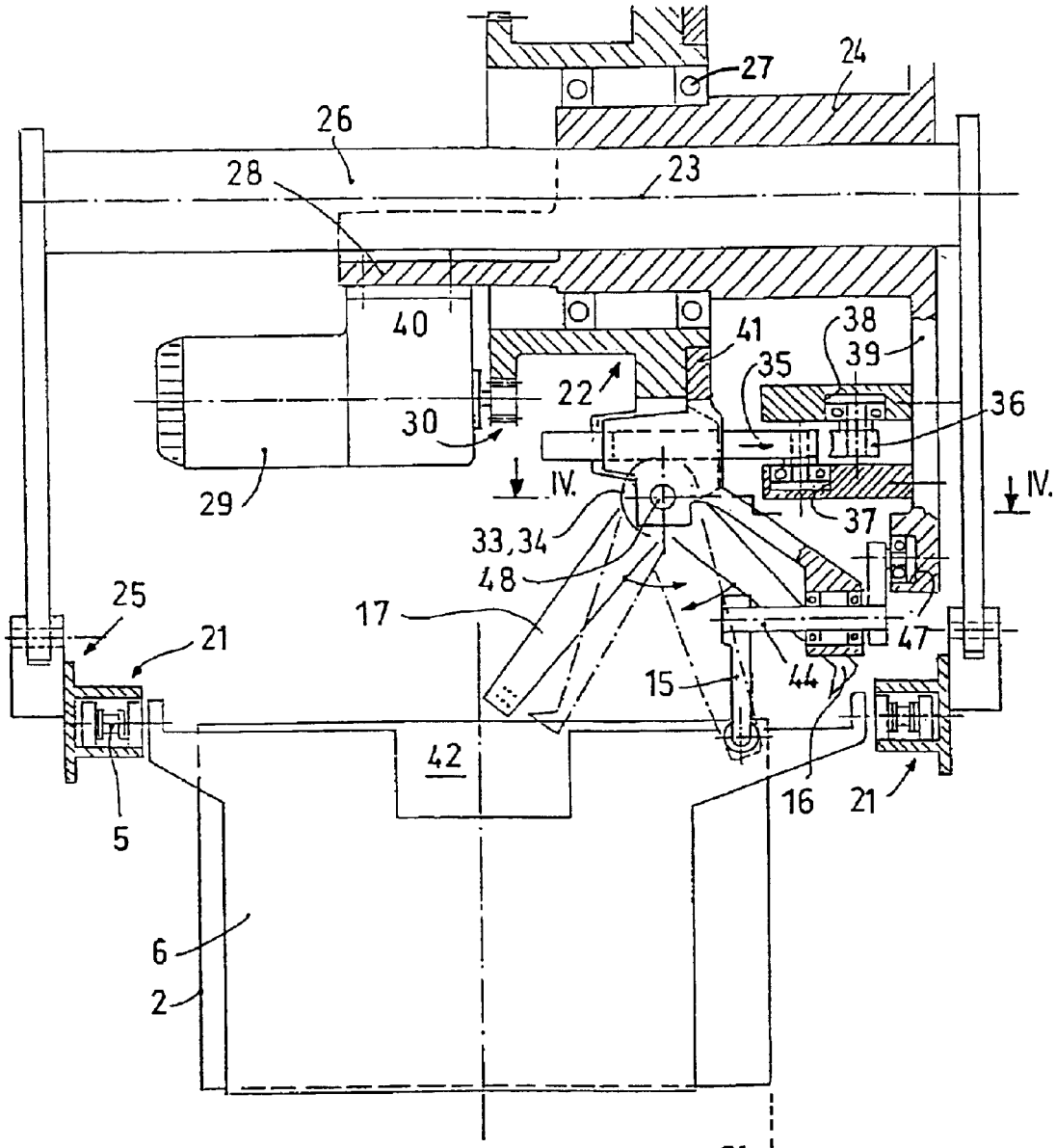
FIG. 3 is a section along line III—III in FIG. 2.

FIGS. 2 and 3 show details of the joint operation of the conveying apparatus 4 and the opening device 12. FIG. 2 shows the movement course for the conveying apparatus 4 and the opposite-arranged opening device 12 in the opening region. The opening device 12 that is, in this example, a drum, is arranged above the conveying section of the conveying apparatus 4 and is provided with opening means that act upon the exposed edge region of the main product 2 inside the receiving container 6. These means essentially comprise a gripping element 15 and a separating element 16, which can be supported by a support element 17 for carrying out the operation.

FIG. 2 shows the operating sequence for opening the inserted main products 2 while they pass through the opening section. The main product 2, fed to the receiving container 6 of the conveying apparatus 4, is closed when it reaches the opening region. In a first step, the gripping element 15, designed in this example as a suction device having a suction head 18, grips the main product 2 on the back of the upper edge region as seen in the conveying direction. A support element 17 that can be engaged is provided to prevent the upper edge region of the main product 2 from evading during this operation. The support element 17 is positioned in front of the main product 2, opposite the suction head 18, thus ensuring a reliable gripping of the rear flank of the main product 2 by the suction gripping element 15. The flanks of the main product 2 are separated and the separating element 16 of the opening device 12 is inserted into the opened main product 2 with the aid of a pivoting movement of the gripping element 15, in a direction counter to the conveying direction F. As soon as the separating element 16 is inserted between the flanks of the main product 2, as a result of carrying out an additional movement counter to the conveying direction F, the gripping element 15 on the rear flank of the main product 2 is released and is moved back to the starting position. The support element 17 also returns to its starting position some distance from the main product 2.

Following the withdrawal of the support element 17, the exposed upper edge of the front flank of the main product 2 is pressed with a gripper 19 against the front inside wall of the receiving container 6. As a result, the main product 2 is immobilized at least on one side and the separating element 16 can complete the opening operation. The main product 2 subsequently is held open and positioned on the fold inside the receiving container 6 so the insert 2' can be inserted. The region of the support element 17 that acts upon the front of the main product 2 could be designed as a suction element to enhance the reliability during the opening operation.

Figure 4:
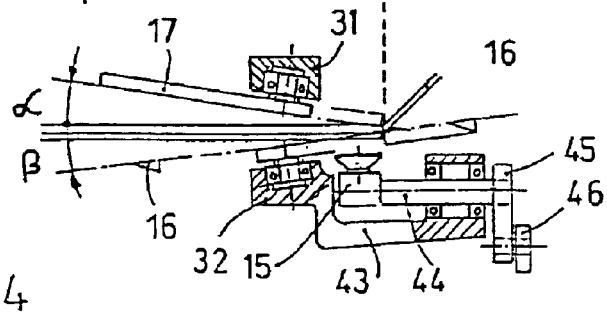
FIG. 4 is a section along line IV—IV in FIG. 3.

FIG. 3 illustrates the joint operation between the opening device 12 and the conveying apparatus 4 that is suspended from conveying chains 5 in side-mounted guide tracks 21. The opening device 12 is provided with a hub 22 on which the aforementioned opening means 15, 16, 17 are arranged. The hub 22, in turn, is positioned on a coupling sleeve 24 that can be displaced along the rotational axis 23 of the opening device 12. The rotational axis 23, on the other hand, is formed by a guide rod 26, which is mounted crosswise to the conveying direction F on a frame 25. A bracket 28 is attached to the coupling sleeve 24 that can be displaced on axial bearings 27. A motor 29 that is drive-connected to the hub 22 is screwed to this bracket. The drive connection is realized with a train of gearwheels 30, wherein a gearwheel sitting on a motor shaft meshes with a gear ring on the hub 22. Adjacent to the gear ring, the hub 22 is provided with bearing devices 31, 32 (FIG. 4), distributed over the circumference, for the separating element 16 and the support element 17. The distance between the bearing devices 31, 32, on which the separating element 16 and the support element 17 are positioned so as to pivot, is adjustable. FIG. 4 shows an arrangement of this type where the support element 17 is positioned so as to pivot directly on the hub 22. In contrast, the separating element 16 and the gripping element 15 are arranged on a bearing device 32 which can be turned relative to the support element 17 on the circumference of hub 22.

Of course, the support element 17 could also be designed adjustable relative to the separating element 16 and the gripping element 15 for changing the distance. The separating element 16 and the support element 17 are each provided with one toothed wheel 33, 34 for actuation, arranged concentric to the pivoting axis 48, wherein the toothed wheels respectively engage toothed racks 35, 36. The toothed racks 35, 36 that extend in a longitudinal direction inside the hub 22 are designed with a control roller on one end. The rollers respectively move along control cams 37, 38, fixedly arranged around rotational axis 23 for respectively driving the separating element 16 and the support element 17. The drive movements of toothed racks 35, 36 for the separating element 16 and the support element 17 are directed approximately parallel to the rotational axis 23.

A flange 39 is provided on the end of the coupling sleeve 24 for securely connecting the control cams 37, 38 to the coupling sleeve 24. The hub 22 is designed with two jointly rotating parts, a drive part 40 and an adjustment part 41 that can be turned in opposite directions for changing the distance between the separating element 16 and the corresponding support element 17.

As shown in FIG. 4, the separating element 16 and the support element 17 move at flat angles $\beta$ and $\alpha$, respectively to the lateral extension of the receiving container 6. In the process, the support element 17 is pivoted ahead of the separating element 16 from the idle position above the conveying apparatus 4, through a recess 42 in the receiving container 6 into an upper side region in the front of the main product 2. The support element 17 lifts the main product 2 off the inside wall of the receiving container 6, so that it can subsequently be opened by the separating element 16 that is pivoted in from the opposite direction (see also FIG. 5 for this). The part of the main product 2 gripped by the separating element 16 is thus moved to the following inside wall of the receiving container 6 and the front portion of the main product 2 (in the conveying direction) is held with the grippers 19 securely against the receiving container 6 (see FIG. 2). The sequences shown in FIG. 5 with references a) to d) reflect this operation, as previously illustrated in FIG. 3.

If the pneumatic gripping element 15 is used, a roller 46 that is attached (freely rotating) to a lever 45, connected to a pivoting shaft 44, moves along a control path 47 on the circumference of flange 39. The gripping element 15 is pivotally positioned on an extension arm 43 that is connected to the adjustment part 41 on the hub 22.

Figure 6:
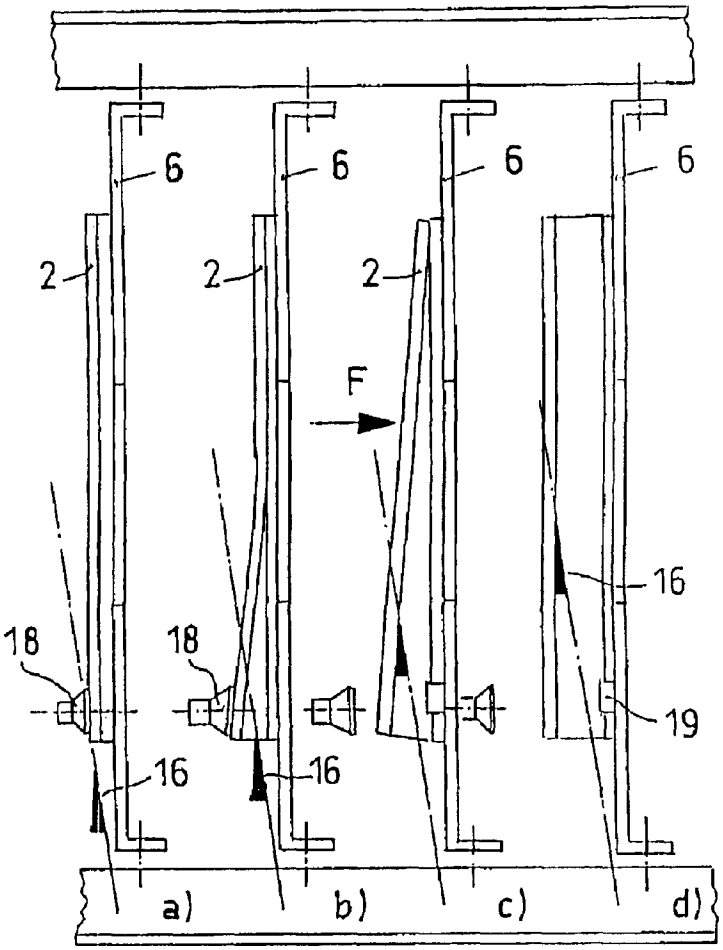
FIG. 6 is a partial top view showing details of the conveying apparatus with an alternatively designed opening region.
Figure 5:
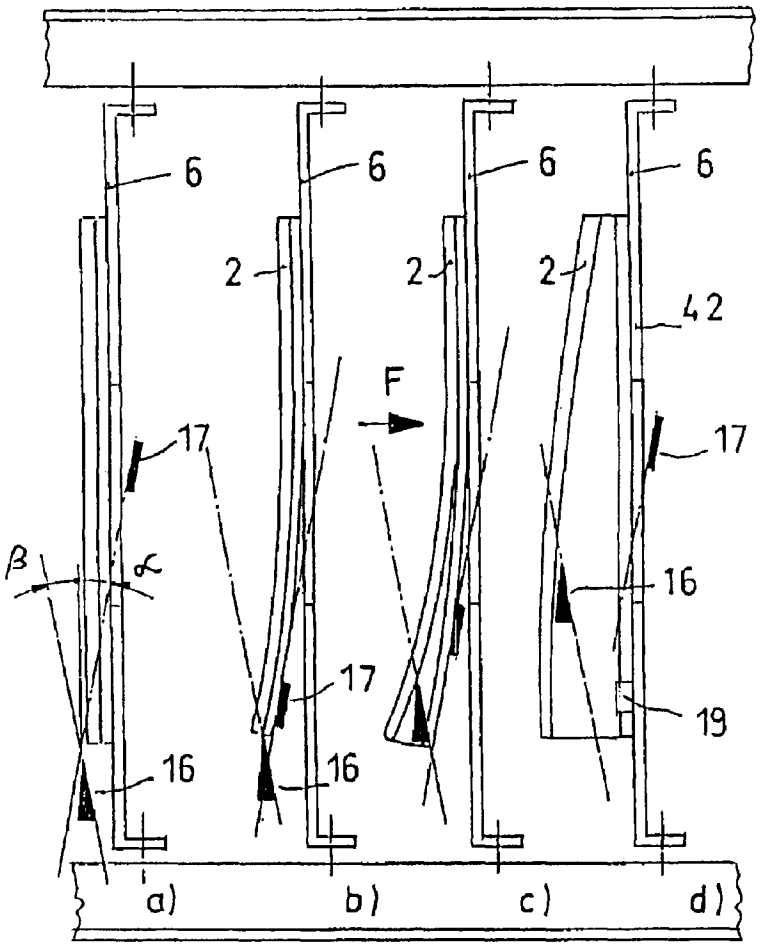
FIG. 5 is a partial top view showing details of the conveying apparatus in the opening region.

According to FIG. 6, the subsequently arriving part of the main product 2 can be lifted up with a suction head 18 and the main product parts can be separated by the subsequently pivoted-in separating element 16. According to FIG. 6, the front wall of the receiving container 6 takes over the rear support function for the operation in place of a support element 17 as shown in FIG. 5.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. An insertion and gathering device for folded products, comprising:

two deflection wheels arranged at a distance to one another;

a conveying apparatus which circulates around the two deflection wheels;

receiving containers coupled to the conveying apparatus for being moved along successively by the conveying apparatus in a conveying direction, the receiving containers each having a pocket with an open upper end constituting an insertion opening and extending crosswise to the conveying direction;

a feed station for feeding the folded products into the insertion openings of the receiving containers fold first;

a removal station for removing the folded products from the receiving containers; and a stationary opening device, arranged between the feed station and the removal station and downstream of the first deflection wheel as seen in the conveying direction, for opening the folded products, wherein the opening device is arranged opposite the insertion opening on the receiving containers and comprises a rotatable opening device that defines with the conveying apparatus a joint opening section that moves in the conveying direction.

2. The device of claim 1, wherein the joint opening section corresponds to a circular sector on the rotatable opening device.

3. The device of claim 1, wherein the opening device is engageable.

4. The device of claim 1, wherein the opening device includes a first opening means for acting on an exposed edge region of the folded product that is inserted into the receiving container.

5. The device of claim 4, wherein sections along the circumference of the rotatable opening device align with the receiving containers.

6. The device of claim 4, wherein the first opening means comprises a gripping element that acts upon an exposed edge on a rear of the folded product; and the opening device further comprises a second opening means including a separating element that is insertable into the opened folded product.

7. The device of claim 6, further comprising a support element that is engageable on a front of the folded product, the support element being coupled to at least one of the gripping element and the separating element.

8. The device of claim 7, wherein the opening device has a hub that rotates around an axis arranged transversely to the conveying direction, and at least one of the support element and the separating element is attached to the hub.

9. The device of claim 8, wherein at least one of the support element and the separating element is adjustable such that a distance between them is adjustable.

10. The device of claim 8, wherein the support element and the separating element are attached to the hub, such that the support element and the separating element each pivot around an axis extending approximately parallel to the conveying direction.

11. The device of claim 8, wherein the gripping element includes a pivoting arm positioned on the hub and a suction head attached to the pivoting arm.

12. The device of claim 11, further comprising means defining a control path and a roller engageable on the control path, wherein the pivoting arm is connected to the roller.

13. The device of claim 12, further comprising a coupling sleeve displaceable along the rotational axis of the rotatable opening device, wherein the hub is positioned on the coupling sleeve.

14. The device of claim 13, wherein the coupling sleeve includes a flange that constitutes the means defining the control path for the gripping element.

15. The device of claim 10, further comprising first and second stationary control cams, wherein the support element is drive-connected to the first stationary control cam, and the separating element is drive-connected to the second stationary control cam.

16. The device of claim 15, further comprising first and second toothed wheels;

first and second toothed racks; and first and second control rollers, wherein the support element is operatively associated with the first toothed wheel, the first toothed wheel engages the first toothed rack, and the first toothed rack is drive-connected via the first control roller to the first stationary control cam, and the separating element is operatively associated with the second toothed wheel, the second toothed wheel engages the second toothed rack, and the second toothed rack is drive-connected via the second control roller to the second stationary control cam.

17. The device of claim 8, further comprising a coupling sleeve, wherein the hub is positioned on the coupling sleeve, and the coupling sleeve is displaceable along the axis of the hub.

18. The device of claim 17, further comprising a motor and a bracket, wherein the opening device is drive-connected to the motor, the bracket is associated with the hub, and the motor is attached to the bracket.

19. The device of claim 1, further comprising a motor, wherein the opening device is drive-connected to the motor.

20. The device of claim 19, further comprising a speed control, wherein the motor is an electric motor and is controlled by the speed control.

* * * * *